US010661953B2

(12) United States Patent
Biskupski

(10) Patent No.: US 10,661,953 B2
(45) Date of Patent: May 26, 2020

(54) MAGNET HOLDER WITH A RECEPTACLE

(71) Applicant: Yeti Dentalprodukte GmbH, Engen (DE)

(72) Inventor: Thomas Biskupski, Engen (DE)

(73) Assignee: Yeti Dentalprodukte GmbH, Engen (DE)

( * ) Notice: Subject to any disclaimer, the term of this patent is extended or adjusted under 35 U.S.C. 154(b) by 0 days.

(21) Appl. No.: 16/306,068

(22) PCT Filed: May 30, 2017

(86) PCT No.: PCT/EP2017/062944
§ 371 (c)(1),
(2) Date: Nov. 30, 2018

(87) PCT Pub. No.: WO2017/207515
PCT Pub. Date: Dec. 7, 2017

(65) Prior Publication Data

US 2019/0135509 A1 May 9, 2019

(30) Foreign Application Priority Data

Jun. 1, 2016 (DE) ..... 10 2016 110 107

(51) Int. Cl.
*B65D 51/24* (2006.01)
*B65D 51/32* (2006.01)
*A61J 1/16* (2006.01)

(52) U.S. Cl.
CPC ..... *B65D 51/242* (2013.01); *A61J 1/16* (2013.01); *B65D 51/32* (2013.01); *B65D 2543/00296* (2013.01)

(58) Field of Classification Search
CPC ..... B65D 51/242; B65D 51/24; B65D 51/32; B65D 2543/00296; B65D 2543/00277; A61J 1/16
USPC ..... 206/350, 570, 557, 571
See application file for complete search history.

(56) References Cited

U.S. PATENT DOCUMENTS 2,160,405 A * 5/1939 Rhodeback ..... B23Q 3/1546 335/295
2,642,999 A 6/1953 McPherson
3,782,799 A 1/1974 Hansen
8,550,251 B1 * 10/2013 Ford ..... A61K 38/28 206/370

(Continued)

FOREIGN PATENT DOCUMENTS

DE 2021741 A1 12/1971
DE 9411069 U1 9/1994

(Continued)

OTHER PUBLICATIONS

International search report for application No. PCT/EP2017/062944 dated Aug. 24, 2017.

*Primary Examiner* — Rafael A Ortiz
(74) *Attorney, Agent, or Firm* — Bachman & LaPointe, PC

(57) ABSTRACT

A receptacle holder (1)—consisting of a U-shaped base part (5) and a holder part (6) that closes the opening of the U-shaped base part, whereby the holder part (6) comprises a magnet, with a receptacle (2) with up to 50 ml fill level, consisting of a vial (3) and a closing part (4), wherein, a ferrous metal is arranged in the closing part (4) and the receptacle (2) is arrangeable on the first side (7) of the holder part (6) that faces towards the U-shaped base part.

11 Claims, 1 Drawing Sheet

(56) References Cited

U.S. PATENT DOCUMENTS

| | | | | |
|---|---|---|---|---|
| 9,210,996 | B1 * | 12/2015 | Kramer | A46B 15/0095 |
| 2012/0043348 | A1 | 2/2012 | Sunatori | |
| 2013/0085467 | A1 * | 4/2013 | Capelli | B65D 81/02 604/416 |
| 2014/0042052 | A1 * | 2/2014 | Tsai | A61J 1/03 206/534 |
| 2014/0061199 | A1 | 3/2014 | Dalbec | |
| 2014/0263889 | A1 | 9/2014 | Hensler | |
| 2015/0359708 | A1 * | 12/2015 | Boomgard | A61J 1/16 206/459.5 |
| 2016/0375201 | A1 * | 12/2016 | Knaub | A61M 5/44 221/131 |
| 2019/0125472 | A1 * | 5/2019 | Lewis | A61B 50/31 |

FOREIGN PATENT DOCUMENTS

| | | | |
|---|---|---|---|
| DE | 19737768 | A1 | 3/1998 |
| DE | 20213066 | U1 | 12/2002 |

* cited by examiner

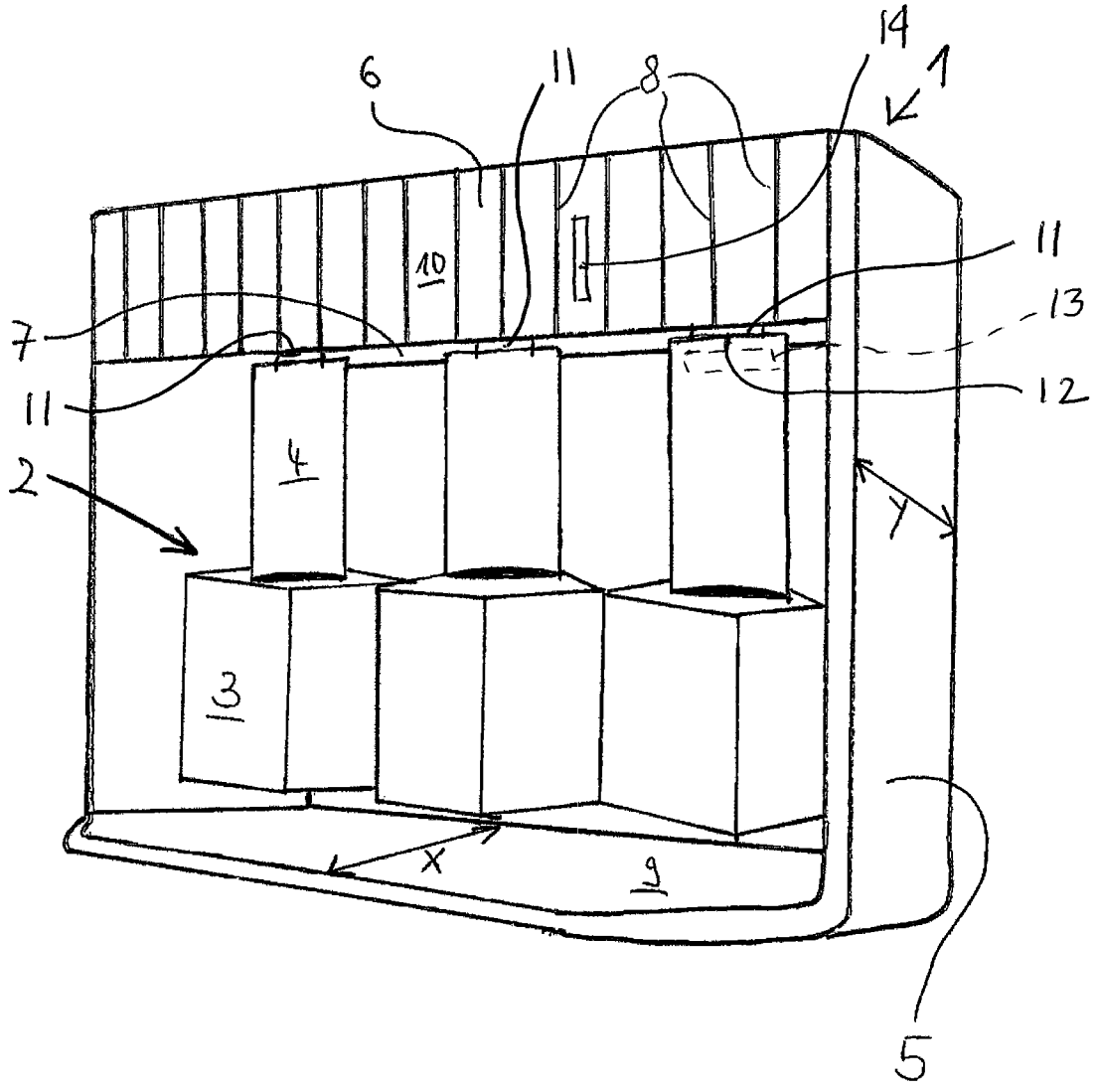
14
1
6
11
8
10
11
13
7
12
11
4
2
Y
3
X
9
5

MAGNET HOLDER WITH A RECEPTACLE

TECHNICAL FIELD

The invention relates to a receptacle holder.

PRIOR ART

Different receptacles are known from the prior art, which hold or affix different objects with the aid of magnets. In this connection, the following documents are of relevance:

- DE 197 37 768 A1; here, a magnetic holding device for a pin of a wireless digitizer is disclosed.
- DE 20 2012 13 066 U1; here, a holding device for small medical instruments is disclosed, whereby a tray-like basic body with several recesses and magnets is provided.
- U.S. Pat. No. 3,782,799; here, a device for holding toothbrushes is disclosed, with which magnets are also used.
- U.S. 2014/0263889 A1; here, a tray-like device is also disclosed for affixing to a table, on which instruments can also be fixed using magnets.

OBJECT OF THE INVENTION

The object of the invention is to provide a receptacle holder for receptacles such as vials, which overcomes the disadvantages of the receptacles known to date, and which can hereby be handled such that it is particularly easy to use.

ATTAINMENT OF THE OBJECT

The features disclosed herein are designed to attain the object. Advantageous designs are also described herein and in the dependent claims.

The receptacle holder according to the invention consists of a U-shaped base part and a holder part that closes the opening of the U-shaped base part. This has the advantage of a simple and attractive form.

The holder part preferably consists of a different material than the U-shaped base part, and it is made of a non-ferrous material, which means that it consists of a material that does not react magnetically. The holder part comprises at least one magnet. The number of magnets is here oriented to the number of receptacles to be held in this receptacle holder. However, a single continuous magnet can also be provided, so that the receptacles to be held are suspendible not only on defined points on the holder part, but over the entire extension of the holder part. Here, it is advantageous that as a result of the magnet, simple and fast storability of the receptacles to be held is achieved.

The magnet is arranged on the side of the holder part, which points downwards in the direction of the U-shaped base part. Here, it is advantageous that the receptacles to be held can be stored and cleared away protected, as it were, by the U-profile of the base part.

The receptacles to be held consist of two elements, a vial and a closing part. These are preferably receptacles for fluids, although receptacles with a powder, such as graphite powder, are also possible as a content. The form, size and material of the vials can advantageously be adapted. In this connection, it is important that the force of the holding magnets is adapted to the weight of the receptacles to be held. The closing part not only has the advantage of closing the vials, but can also be designed in an attractive and functional manner with regard to its form and colour.

Preferably, a total of four vials can be held in the receptacle holder. Here, it has been determined that in most of the intended areas of use, it provides a particularly good coverage of the colours respectively required, for example, and that nevertheless, enables simple handling for suspension or removal, and that even so, it can still be handled during transportation.

It is also provided that these receptacles can for example be so-called brush bottles. These are characterized by the fact that a brush is integrated in the closing part. This integrated brush extends into the interior of the vial when the brush bottle is in a closed state. In an opened state, the closing part serves as a handle for the brush. Here, it is advantageous that the brushes do not have to be cleaned separately, and that no mixing of colours can occur in the brush, for example.

On the apex of the closing part of the receptacles provided, a ferrous metal is integrated. Ferrous metal refers to a ferromagnetic material, such as, and preferably, iron or a suitable iron alloy, or also cobalt or nickel or a suitable alloy with these metals. Of key importance is only that sufficient force of attraction is generated by a magnet.

The apex refers to the upper middle end of the closing part, i.e. the end that faces away from the vial. Here, it is of no key importance whether the apex is designed in the area of a planar surface for better contact on the holder part, which is also designed in a planar manner, or the highest point of an arch, which grips for example in corresponding circular indentations of the holder part in a form-fit manner. Here, it is advantageous when the ferrous metal integrated there is completely enclosed by the material of the closing part. The material of the closing part is preferably a plastic or plastic mixture, although it is also possible for the other materials, such as wood or other non-magnetic metals such as aluminium to be integrated therein.

Via the ferrous metal integrated in the closing part, the magnetic hold on the magnet of the holder part of the receptacle holder is made possible. It is important that no independent magnetic force is emitted from the ferrous metal. This would mean that the receptacles are attracted in an unintended manner, which can lead to significant disadvantages with regard to handling. Here, it is advantageous that as a result of the ferrous metal, a fixed but not determining connection with the magnet is created.

The strength of the magnets used is coordinated with the weight of the receptacles to be held in each case, including an average fill level. This coordination is designed such that the receptacles can already be pulled onto the intended holding point from a distance of 2 to 3 cm. A precise advection is not necessary here, so that handling is made considerably easier and the concentration on the work in hand can remain focussed. This makes it much easier for a user to insert the receptacles into the receptacle holder. A particular tactile experience when the receptacles slide out of the fingers and assume their position is also advantageous.

If the receptacle is held in its intended position via the ferrous magnets on the apex of the closing part by means of the magnet of the holder part, the receptacle, in particular the vials, does not touch the receptacle holder at any other point. Between the vial base and the base of the U-shaped base part, there is a free space that is several mm to several cm in size. This enables, among other things, simple gripping of the receptacle by a user. The attractively designed arrangement of the receptacles, which are stored suspended, as it were, is a further advantage.

In addition, a surface of the base of the U-shaped base part, which extends in the direction of the receptacles or the holder part, is reflected in preferred exemplary embodiments. This reflection of the surface is provided by a reflective film that is adhered or another coating or cover that fulfils this purpose. This reflection effect of the surface on the base of the U-shaped base part makes it easier to read any labels that may be attached and written in mirror writing on the lower side of the vial bases. Additionally, the reflected surface offers the further advantage that impurities such as dust particles can be detected more easily and removed accordingly.

Further, the reflected base of the U-shaped base part is wider than the arms, which taper to the side. The width of the base of the U-shaped base part refers to the distance between the opposite edges of the surface of the base of the U-shaped base part, which do not form the transition to the two arms of the U-shaped profile. This form improves the stability of the receptacle holder.

Further, it can be provided that the U-shaped base part has an anti-slip coating for improved stability. This anti-slip coating is arranged on the side of the U-shaped base part that faces towards the holder part. This is the side that is in contact with the intended installation surface, such as a table. Here, it is advantageous that the U-shaped part is firmly held on the respective subsurfaces.

The holder part further has holding recesses. These holding recesses are groove-like recesses on the side walls of the holder part that are arranged vertically to the installation surface. The side walls of the holder part are also equipped with an anti-slip coating, such as a rubber-reinforced coating.

It is of key importance that behind this coating, further magnets or, if necessary, also the additional magnet that runs over the entire length of the side of the holder part, is integrated. This enables further objects to be held on the holding recesses in addition to the holding of receptacles described above. A prerequisite for this is that these further objects, such as brushes or medical instruments, such as drilling and polishing attachments, comprise a ferrous metal or consist of a ferrous metal.

These additional holding recesses bring the additional advantage that brushes or medical instruments that are not used for a short time can be positioned and held there for further use, and therefore do not have to be set down on a table or tray.

This results in a clear situation at the workstation and also helps ensure that the instruments used do not contaminated through careless setting down or that the storage surface is not contaminated.

The area of application of the receptacle holder lies in the field of dental technology laboratories in particular, and the receptacles and instruments used there. However, it is also possible that a similar use may be considered in other areas that are characterized by the use of similar objects.

DESCRIPTION OF THE FIGURES

Further advantages, features and details of the invention arise from the description of a preferred exemplary embodiment below, and with reference to the drawing, which FIG. 1 shows a perspective view from a side direction onto a receptacle holder 1, which is designed for three receptacles 2.

EXEMPLARY EMBODIMENT

FIG. 1 shows a receptacle holder 1, which in this exemplary embodiment is designed for three receptacles 2.

The receptacle holder 1 consists of a U-shaped base part 5. This U-shaped base part 5 has a widened base, which has a width x, on the side that lies opposite the open side. This width x is larger than the width y of the two tapered arms of the U-shaped base part 5 that are positioned opposite each other.

A surface 9 of the base of the U-shaped base part, which points in the direction of a holder part 6, is reflective. This means that onto this surface 9, a reflective film or other coating is applied that enables reflection.

The opening of the U-shaped base part 5, i.e. the open side, which is positioned opposite the surface 9, is closed by the holder part 6.

In this embodiment, this holder part 6 comprises at least three magnets (schematically illustrated at 11) in order to hold three receptacles 2. The magnets are arranged on the first side 7 of the holder part 6 that faces towards the surface 9.

The receptacle 2 consists of two elements, a vial 3 and a closing part 4. On the apex 12 of the closing part 4, a ferrous metal (schematically illustrated at 13) is integrated, so that the receptacle 2 can be arranged via the closing part 4 onto a magnet 11 of the holder part 6. The apex 12 refers to the point of each closing part 4 that has the greatest distance from the vial 3 and which is positioned on the side facing away from the vial 3.

Further, the distance between the first side 7 of the holder part 6 and the surface 9 of the U-shaped base part 5 is greater than the total length of a receptacle 2. The total length of the receptacle 2 is defined by the distance between the base of the vial 3 and the apex 12 of the closing part 4.

The holder part 6 has several holding recesses 8 on a further side 10. These holding recesses 8 serve to hold further objects, such as brushes or other medical instruments (schematically illustrated at 14).

The further side 10 is covered with an anti-slip material. In this exemplary embodiment, the further side 10 is rubber-reinforced.

Here, the holding recesses 8 are also arranged on the side that is positioned opposite the further side 10 of the holder part 6, and is not visible due to the depiction used in FIG. 1.

| List of reference numerals | |
|---|---|
| 1 | Receptacle holder |
| 2 | Receptacle |
| 3 | Vial |
| 4 | Closing part |
| 5 | U-shaped base part |
| 6 | Holder part |
| 7 | First side |
| 8 | Holder recess |
| 9 | Surface |
| 10 | Further side |
| X | Width of base |
| y | Width of tapered arms |
| 13 | |
| 14 | |
| 15 | |
| 16 | |
| 17 | |
| 18 | |
| 19 | |
| 20 | |
| 21 | |
| 22 | |
| 23 | |
| 24 | |
| 25 | |
| 26 | |

-continued

| List of reference numerals |
|---|
| 27 |
| 28 |
| 29 |
| 30 |
| 31 |
| 32 |
| 33 |

The invention claimed is:

1. A receptacle holder (1)

consisting of a U-shaped base part (5) having a base and two arms defining an opening and a holder part (6) that closes the opening of the U-shaped base part, whereby the holder part (6) comprises a magnet, with a receptacle (2) with up to 50 ml fill level, consisting of a vial (3) and a closing part (4), wherein, a ferrous metal is arranged in the closing part (4) and the receptacle (2) is arrangeable on a first side (7) of the holder part (6) that faces towards the U-shaped base part, wherein a surface (9) of the base of the U-shaped base part (5) that faces the holder part (6) is reflective.

2. The receptacle holder (1) according to claim 1, wherein the ferrous metal is arranged on an apex of the closing part (4).

3. The receptacle holder (1) according to claim 1, wherein the U-shaped base part (5) consists of a different material to the holder part (6).

4. The receptacle holder (1) according to claim 1, wherein the holder part (6) comprises a holding recess (8) for a further object on a further side (10).

5. The receptacle holder (1) according to claim 4, wherein the further object is a brush or a medical instrument, which comprises the ferrous metal.

6. The receptacle holder (1) according to claim 1, wherein the distance between the U-shaped base part (5) and the holder part (6) is greater than the distance between an apex of the closing part (4) and a base of the vial (3) of the receptacle (2).

7. The receptacle holder (1) according to claim 1, wherein the magnet is arranged in the holder part (6), and wherein the holder part (6) comprises of a non-ferrous material.

8. The receptacle holder (1) according to claim 1, wherein a force of the magnet interacts with the ferrous metal in the closing part (4).

9. A receptacle holder (1) consisting of a U-shaped base part (5) having a base and two arms defining an opening and a holder part (6) that closes the opening of the U-shaped base part, whereby the holder part (6) comprises a magnet, with a receptacle (2) with up to 50 ml fill level, consisting of a vial (3) and a closing part (4), wherein, a ferrous metal is arranged in the closing part (4) and the receptacle (2) is arrangeable on a first side (7) of the holder part (6) that faces towards the U-shaped base part, wherein a surface (9) of the base of the U-shaped base part (5) that faces the holder part (6) is reflective.

10. The receptacle holder (1) according to claim 9, wherein a surface (9) of the base of the U-shaped base part (5) that faces the holder part (6) is reflective.

11. The receptacle holder (1) according to claim 9, wherein the base of the U-shaped base part has a width defined by a depth of the U-shaped based part which is greater than a width defined by a depth of the arms.

* * * * *